US007144341B1

(12) United States Patent
Filippini

(10) Patent No.: US 7,144,341 B1
(45) Date of Patent: Dec. 5, 2006

(54) SPORTS RACQUET WITH DEFLECTION ENHANCING STRING BED

(75) Inventor: Rafael G. Filippini, Chula Vista, CA (US)

(73) Assignee: EF Composite Technologies, L.P., San Diego, CA (US)

( * ) Notice: Subject to any disclaimer, the term of this patent is extended or adjusted under 35 U.S.C. 154(b) by 0 days.

(21) Appl. No.: 10/875,926

(22) Filed: Jun. 24, 2004

Related U.S. Application Data

(62) Division of application No. 10/155,458, filed on May 23, 2002, now Pat. No. 6,796,916.

(51) Int. Cl.
*A63B 51/00* (2006.01)
*A63B 49/02* (2006.01)
*A63B 49/08* (2006.01)

(52) U.S. Cl. ..... 473/543; 473/540; 473/537

(58) Field of Classification Search ..... 473/524, 473/537, 532–534, 539–543, 549; D22/124; 43/137

See application file for complete search history.

(56) References Cited

U.S. PATENT DOCUMENTS

| | | | | |
|---|---|---|---|---|
| 1,173,712 | A | 2/1916 | DuBois | |
| 2,089,118 | A | 8/1937 | Fritsch | |
| 2,165,701 | A | 7/1939 | Goerke | |
| 2,206,548 | A | 7/1940 | Goerke | |
| 4,681,319 | A | 7/1987 | Zilinskas | |
| 4,909,510 | A | 3/1990 | Sahatjian | |
| 4,949,968 | A | 8/1990 | Korte-Jungermann | |
| 5,014,987 | A | 5/1991 | Soong | |
| 5,186,459 | A | 2/1993 | Korte-Jungermann | |
| 5,533,298 | A * | 7/1996 | Teng | 43/112 |
| 5,562,283 | A | 10/1996 | Davis et al. | |
| 5,649,702 | A | 7/1997 | Janes et al. | |
| 5,919,104 | A | 7/1999 | Mortvedt et al. | |
| 6,105,306 | A * | 8/2000 | Teng | 43/112 |
| 6,432,005 | B1 | 8/2002 | Lin | |
| 6,506,134 | B1 | 1/2003 | Bertolotti | |
| 2002/0178649 | A1 * | 12/2002 | Betzen | 43/137 |

OTHER PUBLICATIONS

"MAD RAQ Graphite 70", "Cross Strings", Stringer's Digest 1987, pp. 76, 121.*

"Tennis Is King!", Washington Post, Apr. 10, 1975, p. F11.*

"One-Piece Stringing or Two-Piece Stringing?", "Main Strings", Stringer's Digest 1987, pp. 8-10, 12.*

"Preventing Friction Burn", "Weaving the Cross Strings" and "Weaving 'One Ahead'" pictures, Stringer's Digest 2000, pp. 17-18.

* cited by examiner

*Primary Examiner*—Raleigh W. Chiu
(74) *Attorney, Agent, or Firm*—Momkus McCluskey; Jefferson Perkins

(57) ABSTRACT

A racquet for hitting a projectile has a stem, which is a handle or a shaft with a handle, and a racquet head with a frame extending from the handle and supporting a tensioned string bed defining a sweet spot. The frame has an upper portion on an opposing end of the frame relative to the handle and a longitudinal axis extending from the upper portion to the handle. The string bed includes main strings generally running parallel to the longitudinal axis and cross strings running generally perpendicular to the longitudinal axis. The string bed has an upper end defined at an interior surface of the upper portion and a lower end disposed at an interior surface of a lower end of the frame near the handle. A length is defined from the upper end to the lower end of the string bed. The cross strings are only disposed at most within approximately an upper 70% of the length of the string bed.

5 Claims, 9 Drawing Sheets

*FIG. 1*
*(PRIOR ART)*

NON-LONGSTRING RACQUET BOTTOM CROSS STRING POSITION

| RACQUET MAKE | RACQUET MODEL | STRING BED HITTING SURFACE LENGTH | LENGTH FROM FRAME'S UPPER PORTION INTERIOR SURFACE TO BOTTOM CROSS STRING | PERCENTAGE OF STRING/HITTING SURFACE LENGTH TO LENGTH FROM FRAME'S UPPER PORTION INTERIOR SURFACE TO BOTTOM CROSS STRING |
|---|---|---|---|---|
| HEAD | INTELLIGENCE | 15.43 IN | 12.18 IN | 78.90% |
| HEAD | Ti 190 | 15.62 IN | 12.25 IN | 78.80% |
| PRO KENNEX | PURE 1 | 15.8 IN | 13.68 IN | 86.50% |
| WILSON | DLX | 15.06 IN | 12 IN | 79.60% |
| EKTELON | WARRIOR | 14.3 IN | 11.87 IN | 82.60% |
| PRO KENNEX | PRO SABER * | 14.58 IN | 11.51 IN | 78.00% |
| PRO KENNEX | CONQUEST * | 14.28 IN | 11.0 IN | 77.00% |
| PRO KENNEX | PRO SABER * | 14.3 IN | 11.87 IN | 75.00% |

* ALUMINUM RACQUETS WITH AN OPEN THROAT PIECE FORMED AS PART OF THE HANDLE

LONGSTRING RACQUET DEFLECTION DATA

| | TRIAL 1 | TRIAL 2 | TRIAL 3 | TRIAL 4 | TRIAL 5 |
|---|---|---|---|---|---|
| FORCE DISTANCE FROM HEAD | DEFLECTION STD | DEFLECTION 70% | DEFLECTION 68% | DEFLECTION 65% | DEFLECTION 60% |
| 4.2" (106.7 mm) | .568" (14.42mm) | .584" (14.83mm) | .591" (15.00mm) | .595" (15.11mm) | .595" (15.10mm) |
| 5.2" (132.1mm) | .600" (15.24mm) | .633" (16.07mm) | .638" (16.20mm) | .616" (15.65mm) | .623" (15.83mm) |
| 6.2" (157.5mm) | .626" (15.90mm) | .654" (16.60mm) | .656" (16.66mm) | .658" (16.71mm) | .660" (16.76mm) |
| 7.2" (182.9mm) | .638" (16.22mm) | .671" (17.03mm) | .665" (16.90mm) | .678" (17.22mm) | .682" (17.31mm) |
| 8.2" (208.3mm) | .641" (16.29mm) | .680" (17.26mm) | .681" (17.31mm) | .707" (17.95mm) | .722" (18.34mm) |
| 9.2" (233.7mm) | .627" (15.94mm) | .674" (17.13mm) | .684" (17.38mm) | .716" (18.19mm) | .819" (20.81mm) |
| 10.2" (259.1mm) | .585" (14.86mm) | .640" (16.25mm) | .686" (17.42mm) | .797" (20.24mm) | .922" (23.42mm) |

NON-LONGSTRING RACQUET DEFLECTION DATA

| FORCE DISTANCE FROM THE HEAD | DEFLECTION STD | DEFLECTION 70% | DEFLECTION 68% | DEFLECTION 65% | DEFLECTION 60% |
|---|---|---|---|---|---|
| 4.2" (106.7mm) | .598" (15.18mm) | .607" (15.43mm) | .601" (15.26mm) | .613" (15.57mm) | .619" (15.71mm) |
| 5.2" (132.1mm) | .635" (16.13mm) | .646" (16.40mm) | .647" (16.44mm) | .645" (16.37mm) | .647" (16.44mm) |
| 6.2" (157.5mm) | .641" (16.28mm) | .647" (16.44mm) | .648" (16.46mm) | .645" (16.38mm) | .646" (16.41mm) |
| 7.2" (182.9mm) | .629" (15.97mm) | .627" (15.93mm) | .638" (16.20mm) | .637" (16.19mm) | .643" (16.34mm) |
| 8.2" (208.3mm) | .588" (14.94mm) | .589" (14.95mm) | .605" (15.37mm) | .616" (15.65mm) | .659" (16.73mm) |
| 9.2" (233.7mm) | .551" (14.00mm) | .586" (14.89mm) | .598" (15.19mm) | .636" (16.15mm) | .713" (18.11mm) |
| 10.2" (259.1mm) | .516" (13.10mm) | .581" (14.75mm) | .588" (14.93mm) | .639" (16.22mm) | .703" (17.86mm) |

SPORTS RACQUET WITH DEFLECTION ENHANCING STRING BED

CROSS REFERENCE TO RELATED APPLICATION

This application is a division of U.S. patent application Ser. No. 10/155,458 filed May 23, 2002 now U.S. Pat. No. 6,796,916, the specification of which is fully incorporated by reference herein.

BACKGROUND OF THE INVENTION

Sports racquets, such as racquet ball racquets and tennis racquets, have evolved with the objective of improving their strength or power to hit a projectile, such as a ball or other propellable object such as a shuttlecock. The harder and faster a ball is hit and moves, the more difficult it is for an opponent to return the ball by hitting the ball accurately (if at all) with their racquet.

Older, conventional racquets are strung horizontally and vertically in a uniform manner from frame edge to frame edge to form a generally rectangular grid or string bed. Referring to FIG. 1, known non-long string racquets have between 75% and 86% of the length of their string beds or hitting surfaces covered by cross strings. This length is measured from the interior surface of the upper end of the frame of the racquet to the lower most cross string along the longitudinal axis. The string bed length is measured as the distance from the interior surface of the upper end of the frame along the longitudinal axis to an interior surface of the next-encountered, lower frame member.

Certain known aluminum racquets indicated with an * on FIG. 1 have an open throat piece where strings are present. A projectile, however, cannot access this area of these racquets and is not part of the hitting surface. Herein, the term string bed only refers to the hitting surface. These racquets are made with a frame member that begins with a substantially straight section, is curved outwardly and around the string bed, and terminates in a substantially straight section that is disposed close to or substantially parallel to the beginning straight section. The two straight sections (which are also used to form the racquet handle or shaft) are so close together that a projectile cannot get between them. For these racquets, the length of the hitting surface is given as the length along the longitudinal axis of the racquet from the inner surface of the top frame member to the point at which the beginning and ending racquet frame sections are no more than 0.25 inches apart. For tennis rackets, the frame sections are typically about 0.7 inches apart.

Cross strings are provided on the known racquets to brace the main strings laterally so that the impact of the ball on the strings does not push the main strings aside. This would cause a loss of energy while hitting the ball by causing motion of the strings in a direction parallel to the face of the racquet or string bed rather than perpendicular to the string bed as desired to transfer that energy to the ball.

In addition, when a ball is permitted to travel too far through the string bed by pushing the main strings aside, the trajectory of the ball from the string bed will be adversely affected, making it more difficult to control the direction of the ball.

Also for known strings that are used on racquets, the cross strings also help to absorb the impact forces reducing the force on any one string, which further reduces string breaks.

Finally, cross strings may act to dampen vibration.

Cross strings on the string bed, however, constrain deflective movement of the main strings in a direction normal or perpendicular to the string bed. It has been found that the greater the deflection of the string, the greater the "dwell" time with the ball, which stores greater energy. This in turn causes a ball to be propelled from a racquet with more power and speed.

Instead of eliminating cross strings to gain this power, one improvement lengthens the strings instead. This is disclosed, for example, in U.S. Pat. No. 5,919,104 issued to Mortvedt et al., and which is entirely incorporated herein by reference. The '104 patent discloses that the vertical or main strings can be lengthened by wrapping an end of the strings around a pin inside the distal or far end of the handle. Thus, even though the string bed in such a racquet is about 15.5 inches long, the effective length of the main or "long" strings extending into the handle is about 22 inches. For tennis rackets, the effective lengths for long strings are about 27 to 28 inches.

It can be seen from the known racquets that eliminating any major number of cross strings was simply not considered a realistic option. Thus, removing all cross strings has never been considered at all.

SUMMARY OF INVENTION

The problems mentioned above are solved by the invention, which in a first aspect provides a racquet for hitting a projectile, and that has a handle and a racquet head with a frame extending from the handle. It also supports a tensioned string bed. The frame has an upper portion on an opposing end of the frame relative to the handle and a longitudinal axis extending from the upper portion to the handle. The string bed includes main strings generally running parallel to the longitudinal axis and cross strings running generally perpendicular to the longitudinal axis. The string bed has an upper end defined at an interior surface of the upper portion and a lower end disposed at an interior surface of a lower end of the frame near the handle. A length is defined from the upper end to the lower end of the string bed. The cross strings are only disposed at most within approximately an upper 70% of the length of the string bed, and more preferably 68% or 65%, and most preferably at 60%.

In another aspect of the present invention, a racquet for hitting a propellable object, has a racquet head with a frame. The frame has an upper portion at one end and a handle at an opposing end to the upper portion. A tensioned string bed is disposed on the frame and has main strings and cross strings. The string bed defines a longitudinal central axis from the upper portion to the handle end of the frame. The string bed has a length along the axis of at least 15.5 inches, while the string bed has at most 19 cross strings total.

In yet another aspect of the invention, a sports racquet for hitting a projectile has a hollow stem that defines a cavity. A racquet head is attached to the stem and has a frame extending from the handle and supports a tensioned string bed. The frame has an upper portion on an opposing end of the frame relative to the stem. A longitudinal axis extends from the upper portion to the stem, which is either a handle or a shaft attaching a handle to the frame. The string bed includes main long strings generally running parallel to the longitudinal axis. The main long strings extend into the cavity of the stem. Cross strings run generally perpendicular to the longitudinal axis. The string bed has an upper end defined at an interior surface of the upper portion and a lower end disposed at an interior surface of a lower end of the frame near the handle, and a length parallel to the longitudinal axis from the upper end to the lower end of the string bed. The cross strings are only disposed at most within approximately an upper 70% of the length of the string bed measured from the upper end, and more preferably 68% or 65%, and most preferably at 60%.

In yet a further aspect of the invention, a racquet for hitting a propellable object, has a racquet head with a frame. The frame has an upper portion at one end and a hollow stem at an opposing end to the upper portion. The stem defines a cavity and is either a handle or a shaft attaching a handle to the frame. A tensioned string bed is disposed on the frame and has main long strings extending into the cavity. Cross strings are also provided. The string bed defines a longitudinal central axis from the upper portion to the handle end of the frame. The string bed has a maximum length along the axis of about 15.5 inches, while the string bed has at most 19 cross strings total.

The invention also includes a method of stringing a racquet with a frame that has holes for holding a string bed. The frame and string bed have a defined number of main strings and a defined number of cross strings. The method includes the steps of stringing a string in and out of holes on the frame for forming the string bed, and intentionally stopping the stringing before using all holes on the frame provided for the defined number of cross strings. This forms a number of cross strings that is less than the defined number of cross strings to increase deflection of the string bed.

BRIEF DESCRIPTION OF THE DRAWINGS

The above mentioned and other features of the present invention and the manner of obtaining them will be apparent, and the invention itself will be best understood by reference to the following description of the preferred embodiment of the invention in conjunction with the following drawings, in which:

FIG. 1 is a table relating areas of known racquets that are covered by cross strings;

DETAILED DESCRIPTION

Figure 2:
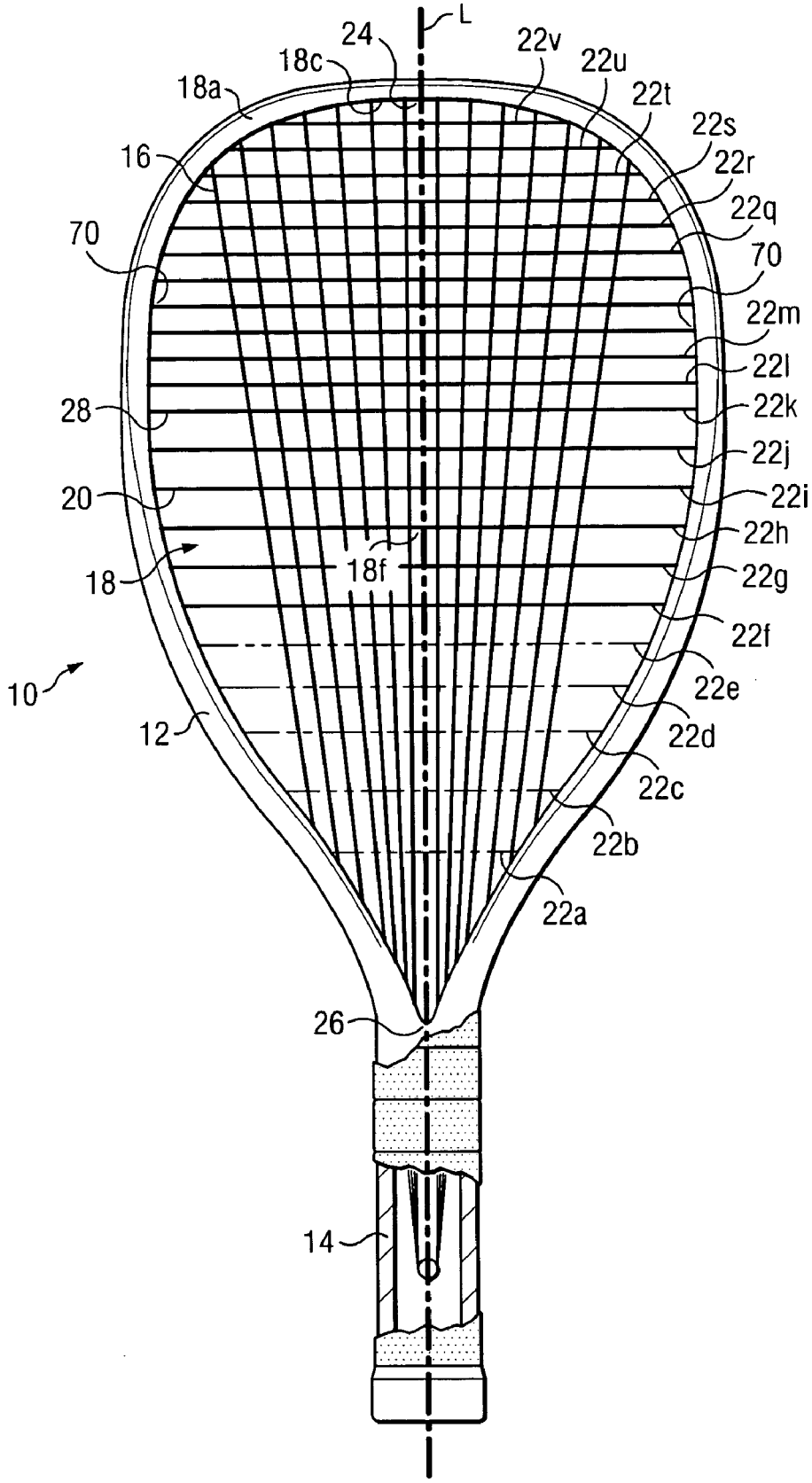
FIG. 2 is a top plan view of a racquet according to the present invention.

Referring to FIG. 2, a racquet 10 is shown such as a modified EF Composite Technologies, L. P. BEDLAM 195™ racquetball racquet (hereafter referred to as the "long string" design or racquet). The racquet 10 typically has a racquet head with a head frame or frame 12 terminating in a preferably hollow stem or handle portion 14 integrally formed with the frame. It also has fourteen main or vertical strings 16, six of which are secured near the bottom of the frame 12, and eight of which extend through a passage in the handle 14 as disclosed in U.S. Pat. No. 5,919,104 incorporated fully herein and also as cited previously. The main strings 16 are generally parallel to a longitudinal axis L of the racquet that extends from an upper portion 18*a* of the frame 12 of the racquet to the handle 14. In the illustrated embodiment, the main strings 16 are not completely parallel to each other but are generally arranged in a fan shaped configuration.

The racquet 10 is originally designed to have a generally planar hitting surface or string bed 18 laterally surrounded by the head frame 12. As used herein, the string bed 18 only refers to the hitting surface as defined by the head frame 12 and extensions into the throat not used to hit a projectile during play are not considered as part of the length of the string bed as measured below.

The string bed 18 has twenty-two cross strings generally indicated at 20 and including cross strings 22*a* to 22*e*, shown in dashed line, and cross strings 22*f* to 22*v* shown in solid line on FIG. 2 that run generally perpendicular to the center line or longitudinal axis L (spacing between cross strings on FIG. 2 not to scale). The string bed 18 is approximately 15.5 inches long measured from an interior surface 18*c* of upper portion 18*a* of the racquet head or frame 12 and, more specifically, at an upper interior point or upper end 24 of the frame 12 to a lower interior end 26 of frame 12 near handle 14. The length of the string bed 18 is measured along axis or center line L. Generally, the cross strings 22*h*–22*v* are spaced uniformly from the top 24 of the frame 12 of the racquet at generally ½ inch spacing for fifteen cross strings.

In the prior art racquet, the remaining seven cross strings 22*a* to 22*g* have increased spacing as the string is positioned closer to the bottom of the frame or handle 14. Thus, in one embodiment, the cross-string spacing increases as one proceeds from middle 22*g* to the bottom 22*a*—approximately as follows: ⅝ inches, 11/16 inches, ¾ inches, ⅞ inches, 15/16 inches, 1 1/16 inches, and 1⅜ inches respectively. The cross strings 20 and main strings 16 are EF Composite Technologies, L.P.'s platinum, gauge 17G string tensioned with constant pull at 30 lbs. In the illustrated embodiment, strings 16 and 22*a*–22*v* are formed of nylon.

It has been discovered that the deflection of the main strings 16 can be substantially increased by removing certain ones of the cross strings 20 without adversely affecting control of the projectile hitting the racquet. This was determined by conducting two experiments and additional field tests. The first experiment used five different string patterns with seven different loading (impact) locations on the BEDLAM™ long string racquet 10. The second experiment used the same string patterns and loading placement on a non-long string racquet. The experiments were conducted using a universal test machine from Dachange Instruments Model #505PC.

For each trial identified below in FIGS. 3–14 for both experiments, the percentage of cross strings (or % string bed pattern) refers to the length of the string bed from the upper portion of the frame that is covered by cross strings (the length from the farthest or lowest cross string to the upper portion of the frame—or interior surface of the upper end of the frame—divided by the total length of the string bed).

Experiment I: Deflection for the Long String Racquet

For both experiments, the racquet was supported on two supports, one at the upper portion 18*a* of the frame 12 and the other support spaced twelve inches away from the first support for five different trials. The string patterns or configurations for the five trials for experiment I are shown in FIG. 2 as follows:

trial (1) no cross strings removed as the control (both solid and dashed lines);

trial (2) the cross strings are only disposed on approximately the upper 70% of the string bed 18 (i.e. the three bottom cross strings 22*a*–22*c* (dashed lines) were removed for a total of nineteen cross strings);

trial (3) the cross strings were only disposed on the upper 68% of the string bed (i.e. the three bottom cross strings 22*a*–22*c* (dashed lines) were removed for a total of nineteen cross strings). In order to accomplish this configuration, the racquet 10 was modified to move cross string 22*d* from the 70% location to the 68% location;

trial (4) the cross strings were only disposed on the upper 65% of the string bed (i.e. four bottom cross strings 22*a*–22*d* were removed for a total of eighteen cross strings); and trial (5) the cross strings were only disposed on the upper 60% of the string bed (i.e. the five bottom cross strings 22*d*–22*e* were removed for a total of seventeen cross strings).

A load of 100 lbs. was applied to each string bed 18 pattern with a flat 60 mm diameter plate or plunger along the longitudinal center L of the racquet. The load was applied at 4.2 inches from the interior surface of the upper end 24 of the frame 12 and at one inch intervals along the centerline of the racquet for six inches until 10.2 inches from the upper portion 18*a* of the frame was reached. The deflection measured at the load point at each inch interval was noted.

Figures 3, 4:
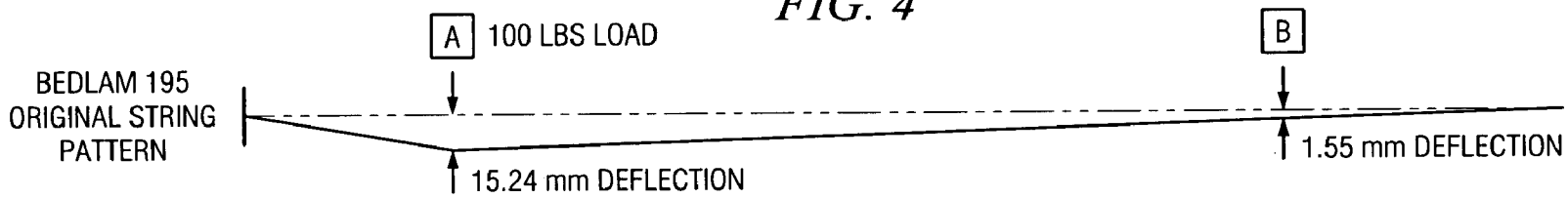
FIG. 3 is a table showing the results of different trials of a deflection experiment for long string racquets.
FIGS. 4–8 are diagrams showing the results of one of the trials from FIG. 3.
Figure 5:
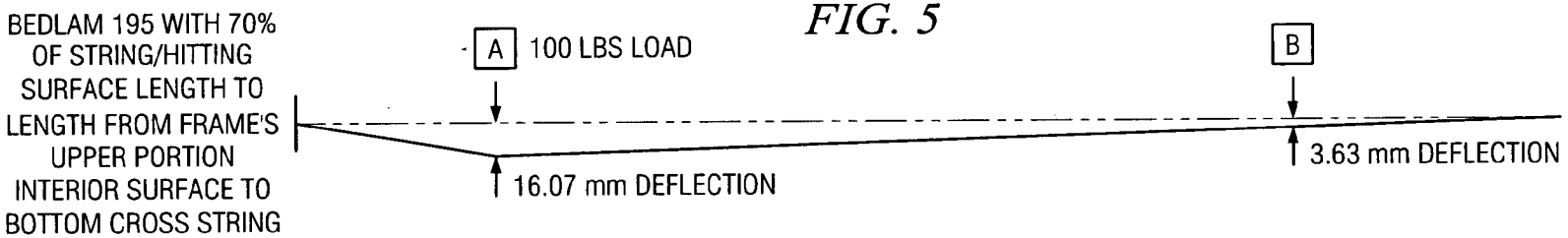
Figure 6:
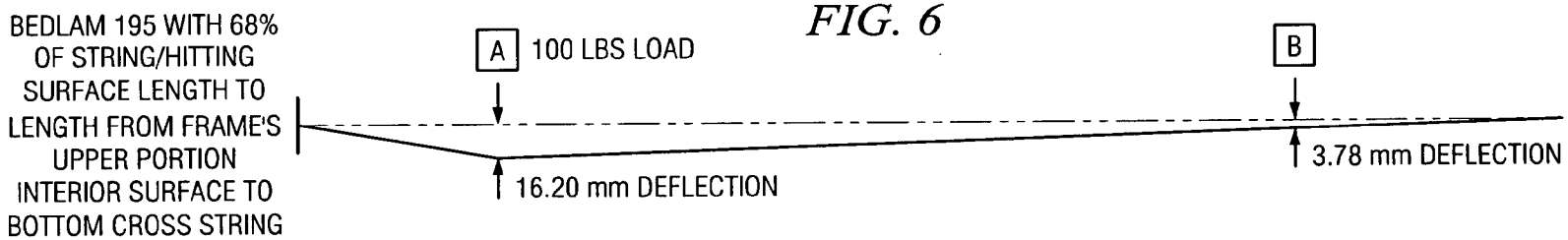
Figure 7:
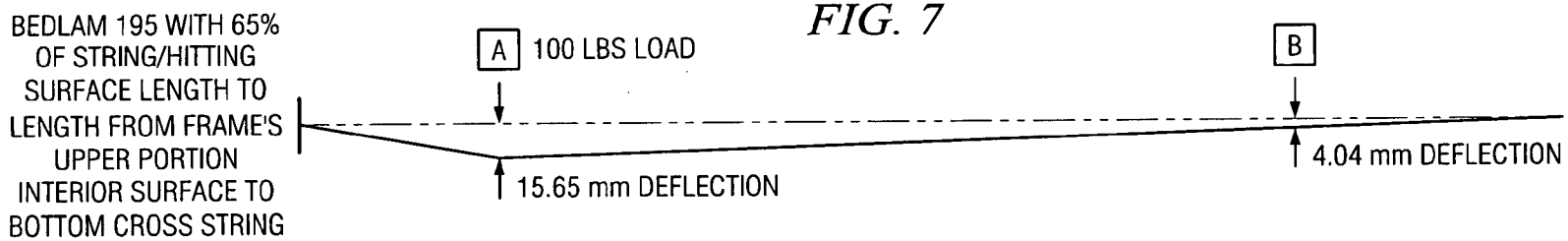

Referring to FIG. 3, a table shows the exact deflection measurements obtained for each trial and for each loading in experiment I. The deflection increased significantly whether the lowest three, four or five cross strings were removed. At the 7.2 inch mark, deflection increased 5.2% for trial (2), 4.2% for trial (3), 4.0% for trial 4, and 6.9% for trial (5). It is believed that the removal of the cross strings 22*a*–22*c*, 22*a*–22*d* or 22*a*–22*e* decreased friction between the cross strings and the main strings 16, and the string bed 18 deflection increased due to the greater freedom of movement for the main strings 16.

Referring to FIGS. 4–7, as another example of the resulting defections on the long string racquet, a diagram of the deflection is provided for when the 100 lb. load was applied at a point A located at the 5.2 inch interval as shown. Here too, deflection increases with removal of the cross strings. For instance, when 70% of the length of the string bed has cross strings (FIG. 5), the deflection increased 5.5% (from 15.24 mm on the original long string string bed to 16.07 mm). Similarly, when 68% of the length of the string bed has cross strings (FIG. 6), the deflection increased 6.3% (from 15.24 mm to 16.20 mm). When 65% of the length of the string bed has cross strings (FIG. 7), the deflection increased 2.6% (from 15.24 mm to 15.65 mm), and when 60% of the length of the string bed has cross strings (FIG. 8), the deflection increased 3.8% (from 15.24 mm to 15.83 mm).

Generally, the increase in deflection within the range of 4.2 inches to 10.2 inches at the upper end of the frame (FIG. 3) ranged from a low of 2.7% (with the load at 5.2 inches and with cross strings covering 65% of the length of the string bed) to a high of 57.6% (with the load at 10.2 inches and with cross strings covering 60% of the length of the string bed). This included increasingly higher deflections through the trials as cross strings were removed (at least at load points 4.2, 6.2 and 8.2–10.2 inches). Thus, experiment I is therefore reliable to show that, generally, the more cross strings were removed from a long string racquet, the greater the deflection at the string bed.

Referring again to the diagrams of FIGS. 4–8, when the load was applied at the 5.2 inch position (point A), the deflection was also measured at 7.60 inches from the bottom of the handle (or 14.4 inches from the upper portion 18*a* of the frame and at the frame's upper end 24) (point B) to show deflection where the cross strings were removed. The results are also graphed in FIGS. 4–8 with the deflection shown in mm.

Figures 8, 9:
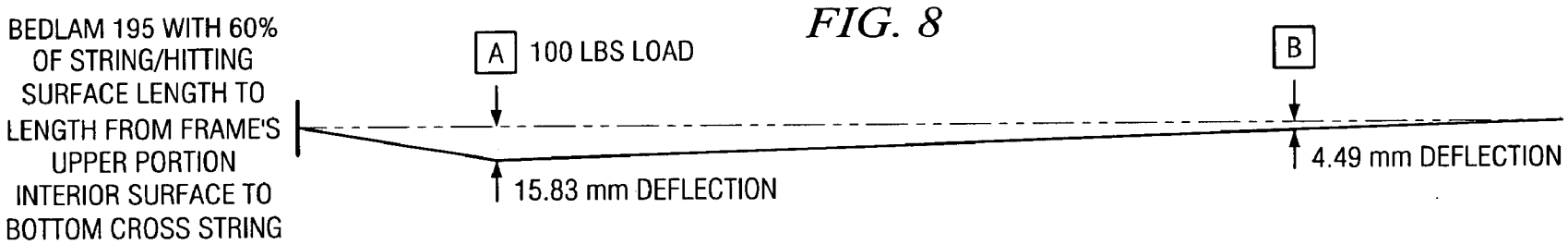
FIG. 9 is a table showing the results of different trials of a deflection experiment for non-long string racquets.
Figure 10:
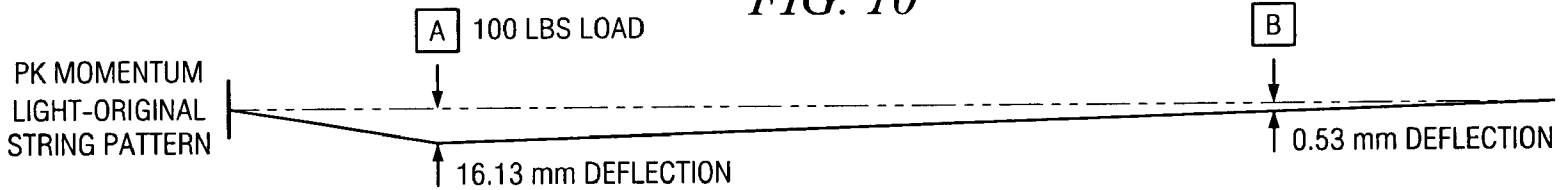
FIGS. 10–14 are diagrams showing the results of one of the trials for the second deflection experiment from FIG. 9.
Figure 11:
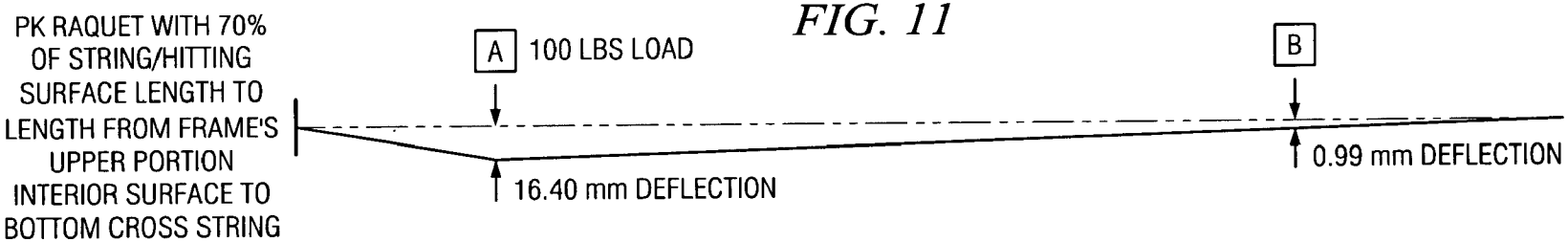
Figure 12:
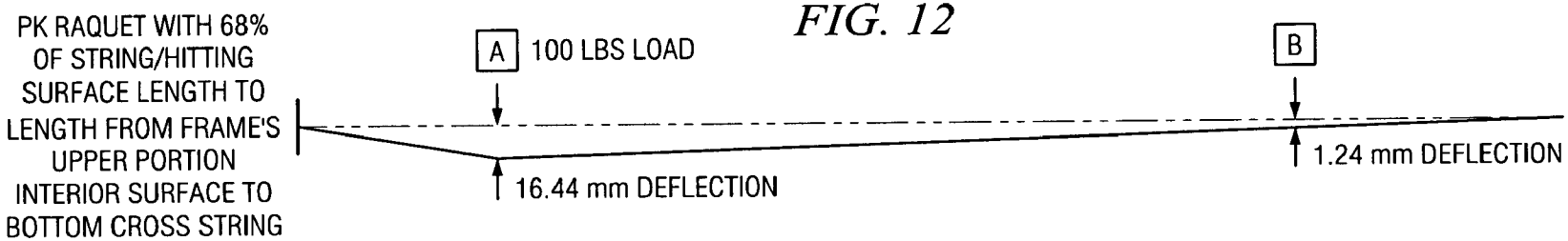
Figure 13:
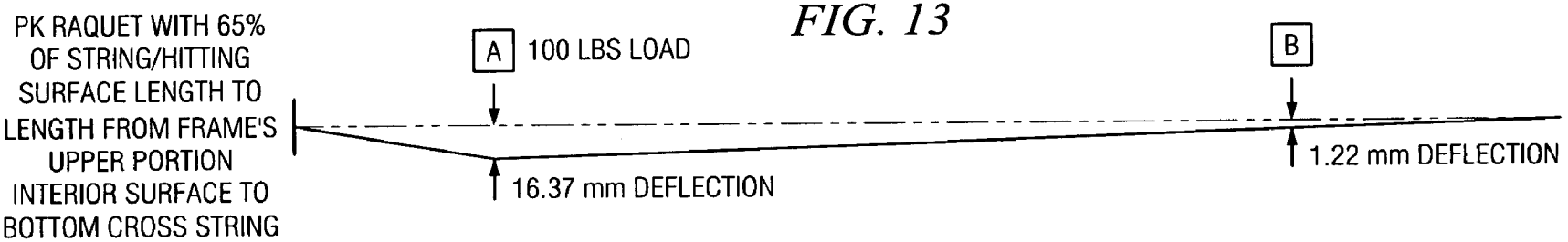
Figure 14:
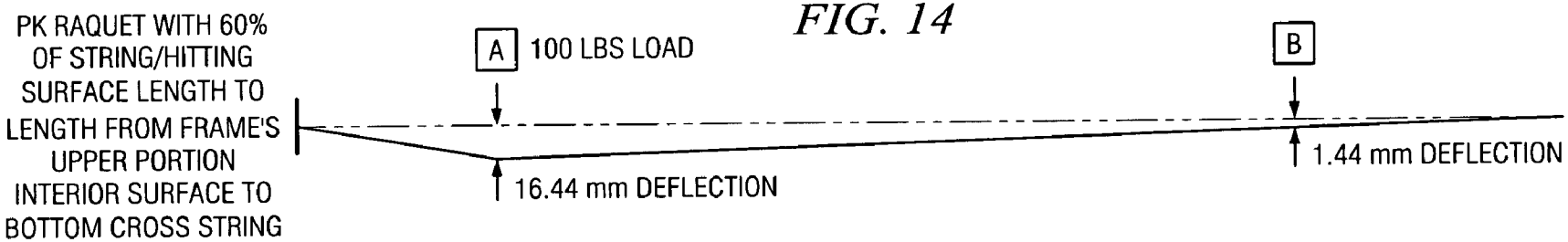

The deflection increased significantly near the bottom of the frame 12 where the cross strings were removed. When 70% of the length of the string bed has cross strings (strings 22*d*–22*v* for nineteen strings were used), deflection increased at point B 134% (FIG. 5); when 68% of the string bed is covered (nineteen strings 22*d*–22*v* were used), deflection increased at point B 144% (FIG. 6); when 65% of the string bed is covered (eighteen strings 22*e*–22*v* were used), the deflection at point B increased 161% (FIG. 7); and when 60% of the string bed is covered (seventeen strings 22*f*–22*v* were used), deflection increased at point B 190% (FIG. 8). This indicates that the deflection of the entire string bed 18 is increased due to the removal of the cross strings when a ball impacts the string bed. This increased deflection permits the storage of more energy, resulting in greater power when hitting the ball.

Experiment II: Deflection for the Non-Long String Racquet

Figure 15:
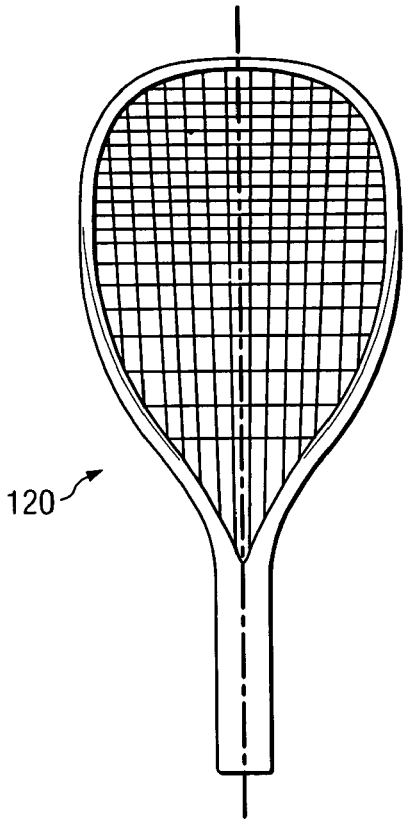
FIGS. 15–16 are plan views of non-long string racquets showing string patterns for the trials of the deflection experiment shown in FIGS. 9–14.
Figure 16:
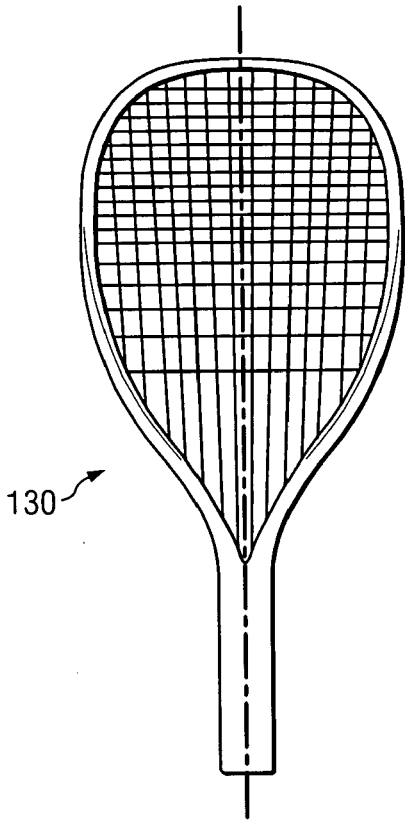
Figure 17:
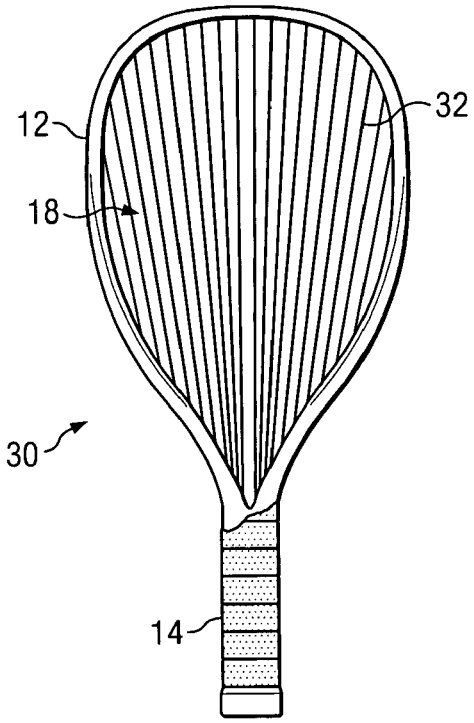
FIG. 17 is a plan view of a racquet with another alternative string pattern.

Referring to FIGS. 9–14, in the second experiment, the same testing apparatus, same loading placement and same string bed patterns with five trials were used. In this case, however, a non-long string PK Momentum Light™ racquet was tested. Thus, the non-long string racquet was tested with: trial (6) no cross strings removed, trial (7) 70% string bed pattern, trial (8) 68% string bed pattern, trial (9) 65% string bed pattern, and trial (10) 60% string bed pattern, each with the load applied from 4.2 inches to 10.2 inches at one inch intervals. A representation of the 70% string bed pattern is shown on a non-long string racquet 120 on FIG. 15, and a representation of the 60% string bed pattern is shown on a non-long string racquet 130 on FIG. 16.

Referring to FIG. 9, a second table shows the data for trials 5–10. Here also, the deflection generally increased at the loading points for the non-long string racquet. When the load was applied at the 7.2 inch mark and measured, deflection increased: 0% for trial (7) with a 70% string bed pattern; 1.4% from 15.97 mm to 16.20 mm for trial (8) with a 68% string bed pattern, 1.3% from 15.97 mm to 16.19 mm for trial (9) with a 65% string bed pattern, and 2.2% from 15.97 mm to 16.34 mm for trial (10) with a 60% string bed pattern.

Referring to FIGS. 10–14, as in experiment I, diagrams are provided for the 5.2 inch mark loading at point A for each trial 6–10. For the 70% string bed pattern (trial 7, FIG. 11), deflection increased 1.7% from 16.13 mm to 16.40 mm; and for the 68% string bed pattern (trial 8, FIG. 12), deflection increased 1.9%. For the 65% string bed pattern (trial 9, FIG. 13), deflection increased 1.5%, and for the 60% string bed pattern (trial 10, FIG. 14), deflection increased 1.9%.

The increasing deflection measured at the upper end of the string bed (from the 4.2 inch mark to the 10.2 inch mark) fell in a range from 0.0% (loading at 8.2 inches for 70% string bed pattern) to 36% (loading at 10.2 inches for 60% string bed pattern). The deflection also increased as cross strings were removed for the 7.2–10.2 inch load points. Thus, this data shows that not only will deflection increase with the removal of lower cross strings whether or not main long strings are present, but also that the more cross strings are removed, the greater the deflection.

Also shown in FIGS. 10–14, it was determined that the deflection increased near the bottom of the frame at point B as in experiment I. For 70% cross string coverage (trial 7, FIG. 11), deflection increased at point B 46%; for 68% cross string coverage (trial 8, FIG. 12), deflection increased at point B 133%; for 65% cross string coverage (trial 9, FIG. 13), deflection increased 129%; and for 60% cross string coverage (trial 10, FIG. 14), the deflection at point B increased 170%.

Again, it is shown that reducing the number of cross strings while maintaining the same string bed size increases deflection of the strings over the entire string bed. It is believed that increasing the dwell time of the ball on the strings consequently returns more energy to the ball, thereby increasing the ball's velocity.

Referring to FIGS. 3 and 9, when comparing the actual increase in deflection on the long string racquet to the non-long string racquet, it can be seen that, for example, trial 2 (long string, FIG. 3) shows deflection increases of 5.5% and 5.2% while trial 7 (non-long string, FIG. 9) shows deflection increases of 1.7% and 0.0% for 5.2 inch and 7.2 inch loading points respectively with a 70% string bed pattern. This difference in the change in deflection exists for all of the data. Thus, it will be realized from these experiments that the reduction of cross strings on the long string racquet design is particularly advantageous. The long string design results in relatively significantly larger increases in deflection than that obtained with the conventional short string racquet. This results in significant increases in stored energy for greater power when hitting a ball.

In addition, the tables also show that for loads or ball impacts from the 6.2 inch mark to the 10.2 inch mark, the long string racquet results in significantly greater deflection than the non-long string racquet. For instance, for a 70% pattern at 7.2 inch loading, long string deflection is 17.03 mm (trial 2) compared to just 15.93 mm (trial 7) for a non-long string racquet. A similar result is achieved for each of the trials for each loading from 6.2 inches to 10.2 inches. This results in relatively more significant stored energy for the long string racquet compared to that of the non-long string racquet.

Field Tests

The modified racquets 10 with the different patterns of cross strings as disclosed above were also provided to experts to confirm that increased deflection translates to increased power and playability without detrimentally affecting trajectory control. The experts were told to rate the racquets in certain categories such as power and control. These experts agreed that as more cross strings were removed, the string bed's of the racquets had more of a "trampoline" feel and increased deflection feel (i.e. the ball seemed to be jumping off of the string bed faster). The experts concluded that the balls had increased speed and power when moving away from the string beds (data not shown). A radar gun was also used to confirm that the balls were in fact faster the more cross strings were removed from the racquets (data not shown). Finally, the experts also agreed that they did not experience any loss of direction, control or other detrimental effects to performance as the cross strings were removed for the cross string patterns already disclosed above.

This configuration (removal of cross strings 20 on the lower end of the string bed 18) is preferred because the field tests mentioned above revealed that no substantial detriment or effect to direction or control occurred when a ball hit in the areas of the string bed 18 where the cross strings 20 were removed. One reason for this is that as the ball contact point approaches the handle, the speed of the string bed relative to the ball decreases as a function of a decrease in the length to the handle. The ball therefore hits the string bed with less force, and misdirection or breakage become less likely.

Thus, while the data generally show that the more cross strings eliminated, the higher the deflection, in one preferred embodiment, for the long string racquet 10 and for optimum performance, the cross strings are disposed preferably at most on the upper approximately 60% to 70% of the string bed 18 (at most the upper about 11 inches of a 15.5 inch string bed). The experiments disclose the preferred values as 70% (trials 2 and 7), 68% (trials 3 and 8) which is about ⅔ of the length of the string bed, 65% (trials 4 and 9), and 60% (trials 5 and 10). While this provides a range of 17 to 19 cross strings on the 15.5 inch long string bed of the modified BEDLAM™ Racquet 10, it will be appreciated that any number of cross strings with the percentages disclosed is still within the scope of the invention.

However, it will be appreciated from the experimental data that whether or not the racquet is a long string racquet, more cross strings can be removed for string beds with cross strings covering less than 60% of the length of the string bed, and that in certain circumstances all cross strings may be removed.

In long string designs, where cross strings are no longer present in more than the bottom twenty percent of the string bed, it is recommended that a dampener be placed across the main strings, either in the stem cavity or on a low part of the string bed, to dampen vibration.

Figure 18:
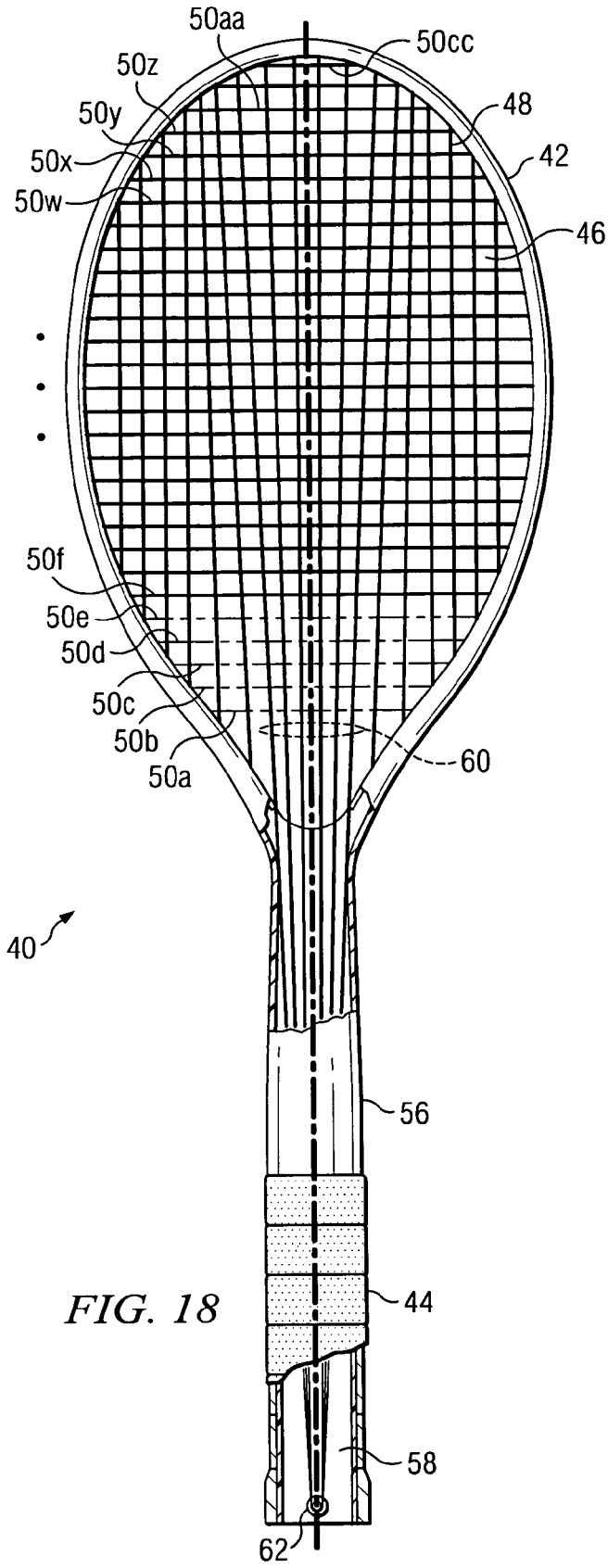
FIG. 18 is a plan view of an alternative racket according to the present invention.

Referring to FIG. 18, while racquetball racquets have been the main focus of discussion and experiments I–II, the conclusions apply equally to other types of racquets such as badminton, squash and tennis rackets. Thus, by way of example, a racket 40 has a head frame 42 coupled to a stem with a handle 44. The handle 44 and head frame 42 are disposed around a center line CL. A generally planar string bed 46 is laterally surrounded by the head frame 42. The string bed 46 has a plurality of main strings 48 strung at least generally parallel to the centerline CL. The main strings may be arranged in a fan-like pattern around the center line CL as shown on FIG. 2. for racquet 10. A plurality of cross strings 50*a* to 50*cc* are strung generally transversely to the main strings 48.

Here, for exemplary purposes only, racket 40 is shown with five bottom cross strings 50*a*–50*e* (shown in dashed line) proximate the handle 44 removed or omitted. It will also be appreciated that any of the ranges for removal or omission of cross strings already disclosed above apply equally for racket 40.

In addition, racket 40 can also have the long string configuration even though the stem has a support member or shaft 56 connecting the handle 44 to the head frame 42. In this case, the handle 44 has a chamber 58 formed in the handle around the centerline CL to communicate with the string bed 46. At least some of the main strings 60 have a lower terminus 62 within the chamber 58. The shaft 56 is integrally formed with the handle 44 and head frame 42.

For manufacture of the racquetball racquet 10, it will be appreciated that the frame 12 of the racquet can be built with a frame that omits the devices for securing cross strings 20 to the frame 12 such as holes 70 where each cross string end enters the frame 12. In the alternative, however, another aspect of the present invention is using a racquet that is designed for a full bed or a defined number of cross strings, such as frame 12 that holds twenty-two cross strings 20, and then simply omitting the cross strings in the positions where such omission is desired. In other words, to string racquet 10, a single continuous string 28 (or any plurality of strings—two strings are used often) can be pulled through holes on frame 12 for main strings 16 first and then the cross strings 20, the weaving or stringing process is then intentionally stopped before all of the holes provided for cross strings 20 are filled or used by the string 28. The unused holes should preferably be disposed on the lower or handle end of frame 12. Once the stringing has stopped, the string should be cut (if not already precut to a selected size) and then tied/knotted to secure the string 28 to the frame 12. The result is a racquet with a number of cross strings that is less than the defined number of cross strings the frame 12 is designed for.

The advantages of the present racquet are now apparent. The racquet 10 has cross strings 20 removed or omitted from at least the lower end of the string bed 18 to provide greater deflection when hitting a ball on the entire string bed. This results in greater power and speed for the ball, and this is accomplished without sacrificing significant trajectory control of the ball.

While various embodiments of the present invention have been described, it should be understood that other modifications and alternatives can be made without departing from the spirit and scope of the invention, which should be determined from the appended claims.

I claim:

1. A completely strung sports racquet, ready for play, the racquet adapted for hitting a projectile, the racquet comprising:

a handle;

a head frame operatively connected to the handle, the handle and head frame formed around a center line; and a string bed comprising a plurality of tensioned main strings strung across the head frame to be generally parallel to the center line, the string bed containing no strings intersecting the main strings, wherein the main strings extend into a shaft or handle extending from said frame.

2. The racquet of claim 1, wherein said main strings are tensioned at over 30 lbs.

3. The racquet of claim 1, wherein said main strings are approximately twenty two inches long.

4. The racquet of claim 1, wherein said frame is a composite frame with said handle being integrally formed with said frame.

5. The racquet of claim 1, wherein said string bed has at least fourteen main strings.

* * * * *